US010937398B2

(12) United States Patent
Weninger

(10) Patent No.: US 10,937,398 B2
(45) Date of Patent: Mar. 2, 2021

(54) DEVICE FOR A PERCUSSION INSTRUMENT

(71) Applicant: Johannes Weninger, Osthofen (DE)

(72) Inventor: Johannes Weninger, Osthofen (DE)

(73) Assignee: Johannes Weninger, Osthofen (DE)

( * ) Notice: Subject to any disclaimer, the term of this patent is extended or adjusted under 35 U.S.C. 154(b) by 0 days.

(21) Appl. No.: 16/317,879

(22) PCT Filed: Sep. 26, 2017

(86) PCT No.: PCT/EP2017/074373
§ 371 (c)(1),
(2) Date: Jan. 15, 2019

(87) PCT Pub. No.: WO2018/055201
PCT Pub. Date: Mar. 29, 2018

(65) Prior Publication Data

US 2019/0311701 A1 Oct. 10, 2019

(30) Foreign Application Priority Data

Sep. 26, 2016 (DE) ..... 10 2016 118 169.2

(51) Int. Cl.
*G10D 13/02* (2020.01)
*G10D 13/10* (2020.01)

(52) U.S. Cl.
CPC ..... *G10D 13/02* (2013.01); *G10D 13/10* (2020.02); *G10D 13/28* (2020.02)

(58) Field of Classification Search
CPC ..... G10D 13/021; G10D 13/026
See application file for complete search history.

(56) References Cited

U.S. PATENT DOCUMENTS

| | | | | |
|---|---|---|---|---|
| 5,600,080 | A | 2/1997 | Belli | |
| 6,028,258 | A | 2/2000 | Hicks | |
| 6,060,652 | A | 3/2000 | Lombardi | |
| 6,107,555 | A | 8/2000 | Hoshino | |
| 7,511,209 | B1 * | 3/2009 | Liao | G10D 13/026 84/411 R |
| 7,906,718 | B1 | 3/2011 | Liao | |
| 2009/0173211 | A1 | 7/2009 | Okamoto | |
| 2012/0174732 | A1 | 7/2012 | Martinazzi | |
| 2014/0026735 | A1 | 1/2014 | Sato | |
| 2019/0019479 | A1 * | 1/2019 | Strickland | G10D 13/022 |

FOREIGN PATENT DOCUMENTS

| | | |
|---|---|---|
| DE | 4302134 | 7/1994 |
| DE | 29708882 | 7/1997 |
| JP | H11119770 | 4/1999 |

* cited by examiner

*Primary Examiner* — Kimberly R Lockett
(74) *Attorney, Agent, or Firm* — Holzer Patel Drennan

(57) ABSTRACT

The invention relates to a drum and to a device (1) therefor, having a system (3) for altering the attack and decay behavior, in particular the note length of the drum (2). The aim of the invention is to provide a device for a drum and a drum having such a device, which can alter the attack and decay behavior quickly and with little effort, and in particular enables setting of the note length and also of the timbre of the drum largely independently of the pitch. This aim is achieved in that the system (3) is fastened to the drum (100, 2) and has a clip (5) on which an adjustable connecting element (6) is arranged, which is designed for a connection to a support arm or to a base support (7).

17 Claims, 4 Drawing Sheets a)

b)

c)

DEVICE FOR A PERCUSSION INSTRUMENT

Figure 1:
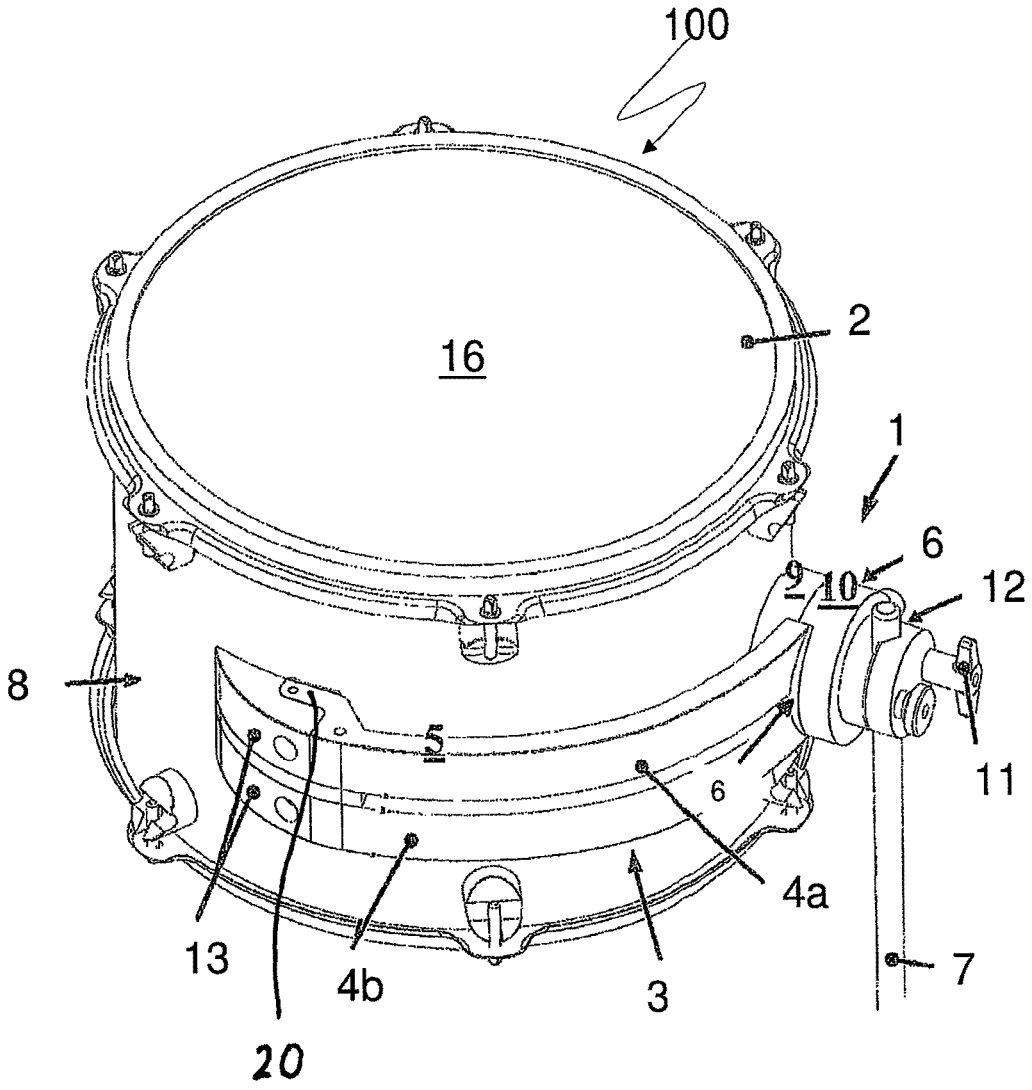

The invention relates to a device for a percussion instrument with an apparatus for altering the attack and/or decay behaviour of the percussion instrument, in particular for altering the note length.

In Western music, a distinction is drawn between the drum and the timpani. Thus the noise predominates when the drum is played, whereas the timpani is tuned to a specific note with clearly defined pitch. It is already known to use a mechanism to tension the head of the timpani while it is being played and hereby alter the pitch, so that the instrument can be used tonally.

The ratio of the shell diameter to the shell depth varies greatly. Floor toms are often deeper than hanging toms of the same diameter. The so-called rototoms constitute an exception. They consist only of a flat metal frame, on which the drum head is tensioned; there is no shell. A screw construction makes it possible to alter the tension of the head while it is being played, with the result that a glissando can be produced by rotating the frame. The term glissando, also glissato, glisscato, glissicando, derived from the French word glisser "to slide", denotes in music the continuous sliding alteration of the pitch. Closely related to the term glissando, and partly overlapping with it, is also the musical ornament portamento.

With percussion instruments—such as drums or toms—it is difficult to adjust the note length or the sustain precisely with conventional means. Up to now, an alteration, in particular a reduction, of the note length was achieved predominantly by external dampers which were affixed e.g. to the head, or were attached to the drum hoop of the head and in turn pressed against the head by an adjustment screw. In the case of electronic recording or transmission, the note length was adjusted artificially by the recording engineer using a gate on the mixer.

By tuning or detuning the heads, it was possible to obtain the desired sustain within specific limits. However, these methods were always fraught with compromises. In other words, when the tonal tuning of the toms or drums to one another is actually good, often a very varied sustain of the drums, which is either too short or too long, but not uniform, is obtained with the known means and methods.

If a head is taped or provided with a damper, although the corresponding note lengths can be shortened, overtones are also lost as a result of taping and damping. An imbalanced acoustic pattern is obtained. If the sustain is determined by the recording engineer using a gate on the mixer during electronic recording or amplification, the tom can no longer be played quietly because the gate opens the microphone for sound only when a volume specified by the recording engineer is reached. A further problem is that the sustain cannot be made longer than it is without any damping. In other words, if the percussionist wants more sustain than the maximum the tom can produce without any damping, up to now there has been no solution for a prolonged sustain other than electronic measures. Different music styles need different sustains for the same tom. It is therefore customary for percussionists to have different percussion sets to meet the requirements of the music styles. It is not customary and not desired to provide several percussion instruments for the musicians in one concert.

The object of the invention is therefore to create a device for a percussion instrument and a percussion instrument with such a device which can alter the attack and decay behaviour, in particular allows the note length and also the timbre of the percussion instrument to be adjusted largely independently of the pitch.

The object on which the invention is based is achieved by a device according to claim 1 and a percussion instrument with such a device.

The device consists substantially of a clip which can be fastened to a percussion instrument, on which clip in turn a connecting element to a stand or tripod is arranged displaceable in the longitudinal direction of the clip and can be fixed in a desired position. Vibrations of the percussion instrument are transmitted to the clip via the fastening of the clip to the shell (or to a drum hoop) and the effective vibrating length of the clip determines the note length (=sustain). This effective vibrating length of the clip is in turn specified by the position of the connecting element fixed on the clip.

It is hereby easily possible to adjust the sustain very precisely in a few seconds without laborious manipulation. Thus, according to the invention, the sustain on the tom can be prolonged as required. The apparatus fastened to the percussion instrument for altering the attack and decay behaviour serves simultaneously as a bracket for the percussion instrument on a tripod or stand. This bracket makes it possible to adapt the same percussion instrument to any music style. During a concert, the percussionist can very quickly alter their sound or the sustain on the tom for a different song by loosening the connecting element on the clip, displacing it and fixing it anew in a different position.

Viewed in this light, the invention relates to a percussion instrument bracket with the help of which the "sustain", i.e. the length of the sound of the drum or tom can be altered in a very short space of time, even during a music performance. For this, the percussion instrument bracket is displaced along a clip, i.e. parallel to the wall of the percussion instrument, or more specifically a drum, continuously to a desired position along the clip.

The term "pulsatile instrument" or percussion instrument used here in the claims and in the description relates to all drums which are covered with one or more heads—consisting of animal skins, plastic or another thin material. With many drums, the noisy character of the instruments, which are used or beaten rhythmically similarly to struck drums or produce similar sounds to these, predominates in the sound. Drums sometimes include in particular some idiophonic pulsatile instruments (such as slit drums and idiophonic water drums), but also other instruments such as jew's harps. Often such instruments are instead also classed with struck drums under more general headings such as pulsatile instrument or percussion instrument. The percussion instrument to which the present invention relates has as a rule, but not necessarily, a shell, at least one head covering the shell, and apparatuses for adjusting the tension of the head (and thus for adjusting the pitch). In the simplest case, the percussion instrument consists only of the head and a tensioning hoop, to which a device according to the invention can be fastened.

Conventional percussion instruments of this type are often supported by their drum hoop, with which the head is fastened at the same time. The drum hoop for its part is tensioned via so-called "lugs" which are distributed at regular intervals around the shell and fastened to it. A connecting element to a tripod or similar is then located on the drum hoop. Alternatively, connecting elements which are fastened directly to the shell are also found.

In one variant of the present invention, however, the percussion instrument is suspended exclusively via the clip for adjusting the note length, wherein the clip is fastened in particular only with one of its ends and preferably to the shell of the drum. However, a fastening to the lugs of a shell or to a drum hoop is not thereby excluded, in particular if the percussion instrument has no shell.

One possibility, according to a development of the invention, is for the holder or bracket of the percussion instrument to be formed as a shaped, for example as a forged, milled and/or bent clip.

It is furthermore advantageous that the clip forms an arc which is matched to the outer circumference of a wall of the percussion instrument and is arranged at a distance which is as constant as possible over a certain length from the outside or the wall of the percussion instrument.

Expediently, the connecting element, housed displaceable on the clip, for a tripod or similar can be fixed at desired points on the clip with the help of a clamping device or quick clamp device.

It is furthermore advantageous if the connecting element has a quick clamp device with flange parts which together surround the clips, wherein one flange part can be pressed on the inside and the second flange part can be pressed on the outside of the clip with the help of a clamping lever or at least one tensioning screw.

According to a preferred embodiment of the invention, the connecting element has an opening in which a support arm or a tripod pin can be housed and clamped.

In one embodiment, the clip consists of two parallel prongs, arranged at a distance from each other, with a substantially constant cross section on which the connecting element is housed displaceable. By using the same displaceable connecting element, expediently with the already mentioned flange parts, and using clips with the same cross section, drums of different sizes can be easily connected to the support.

It is furthermore advantageous if the fastened end of the clip is connected rigidly and/or adjustably to a replaceable, self-supporting connecting part which represents an extension of the clip beyond its fastening end. The connecting part expediently has a mass that can be varied within a broad range by replacement and, because of its respective mass, has a decisive influence on the attack and decay behaviour, including the note length of the percussion instrument. According to one embodiment, the clip runs in an arc plane parallel to the drum head plane, but if necessary can also have an angular position which can be changed in relation to the drum head plane.

It is also advantageous that the clip is arranged self-supporting over at least one part of its length starting from its fastening end connected to the percussion instrument.

The connecting part starting from the fastening end also has substantial influence on the sound. The timbre and the length of the sound and the sound volume can be influenced by changing the mass of the connecting part and/or adjusting the connecting element on the clip.

It is furthermore advantageous that the percussion instrument is a drum or tom or a cymbal or an instrument which can be covered with one or more heads consisting of animal skins, plastic or another thin material.

In one embodiment, the clip or its prongs can have one or more inner cavities. The cavities influence the natural frequency of the clip and thus also the damping or prolonging of the note length in the case of otherwise identical external dimensions of the clip and identical adjustment of the connecting element.

For example, the inner cavities can be several holes of the same or also different diameter in the clip, which extend perpendicular to the plane of curvature of the clip.

Further advantages and details of the invention are explained in the claims and in the description and represented in the figures.

Figure 2:
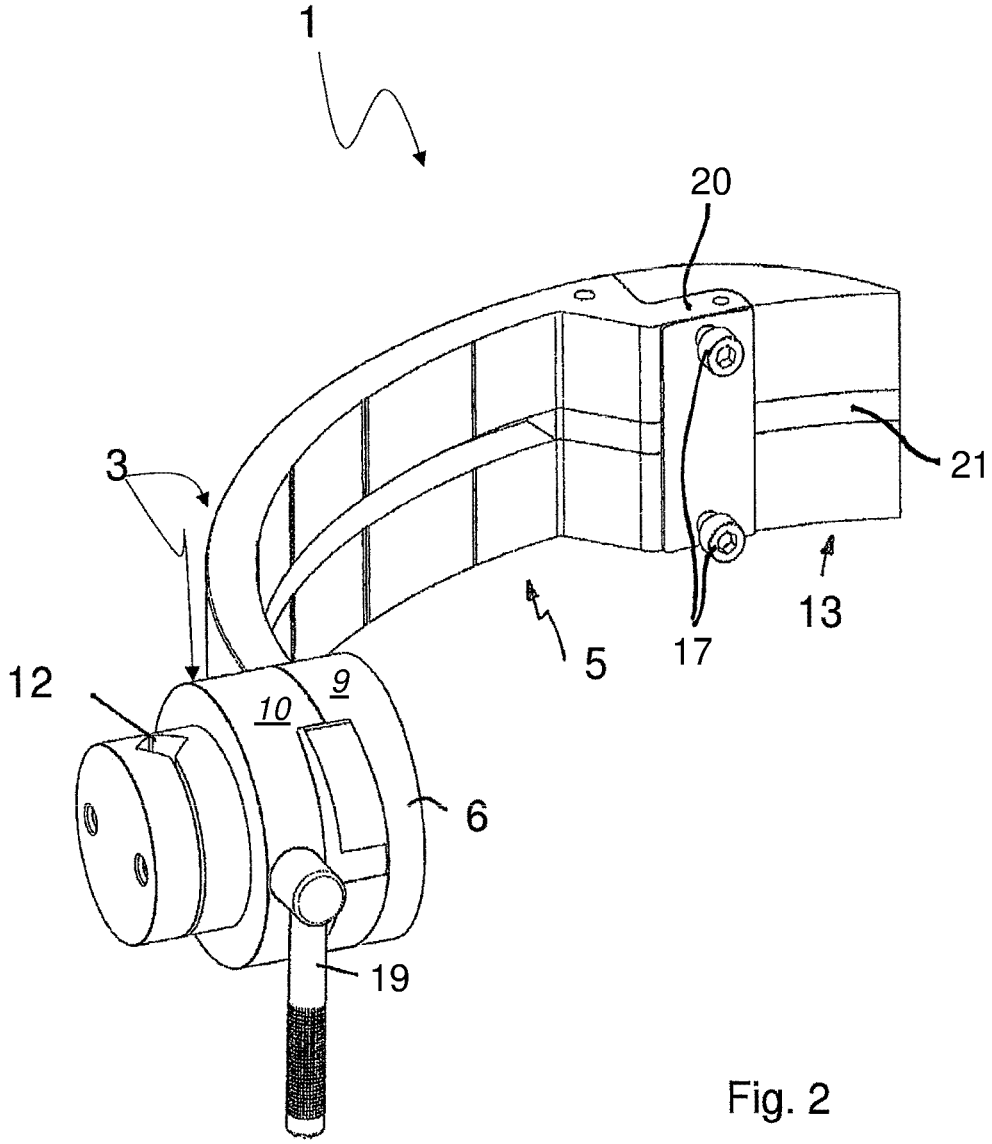
Figure 3:
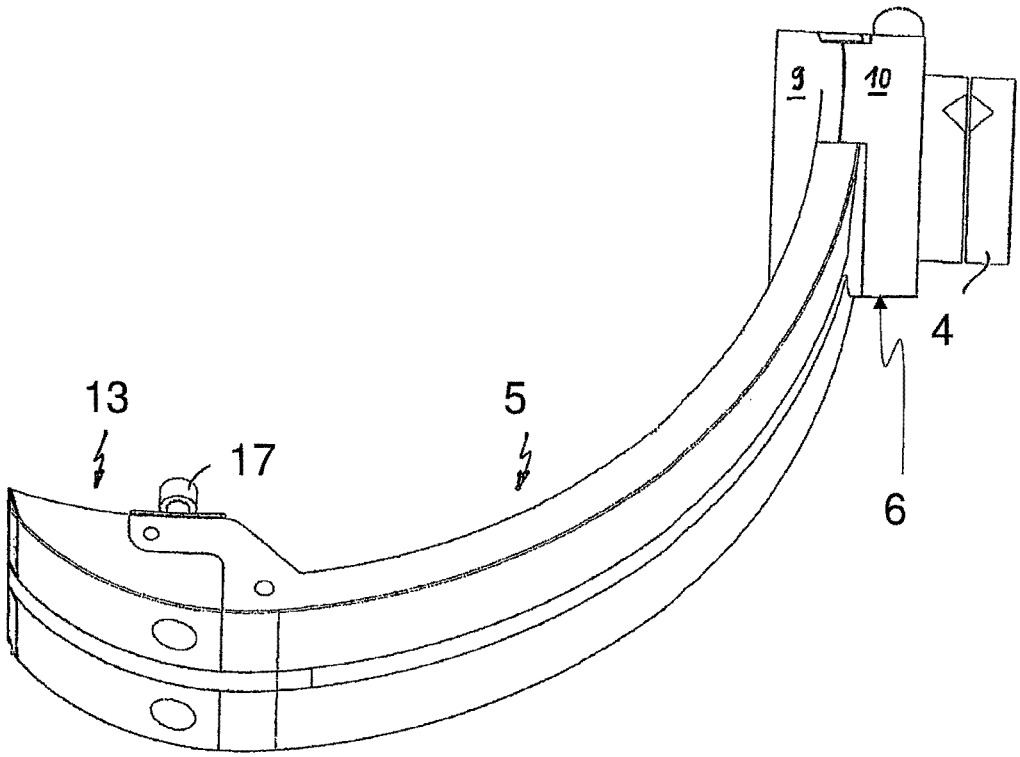
Figure 4:
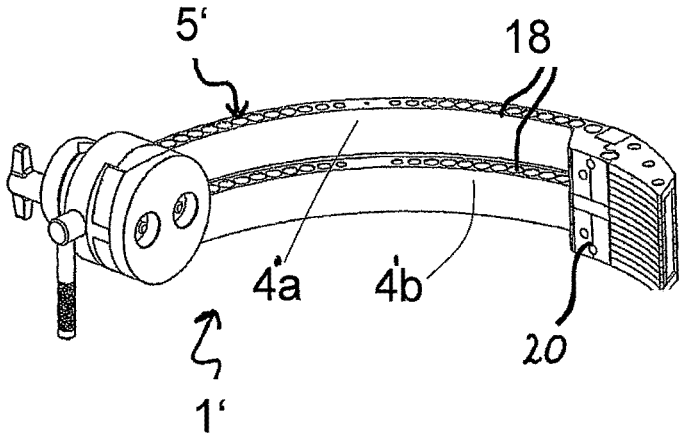
Figure 4:
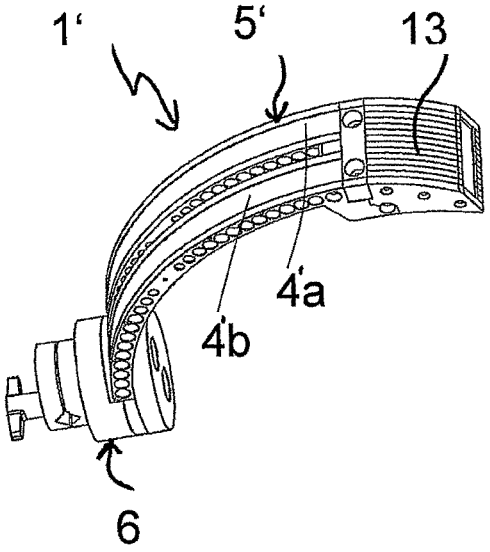
Figure 4:
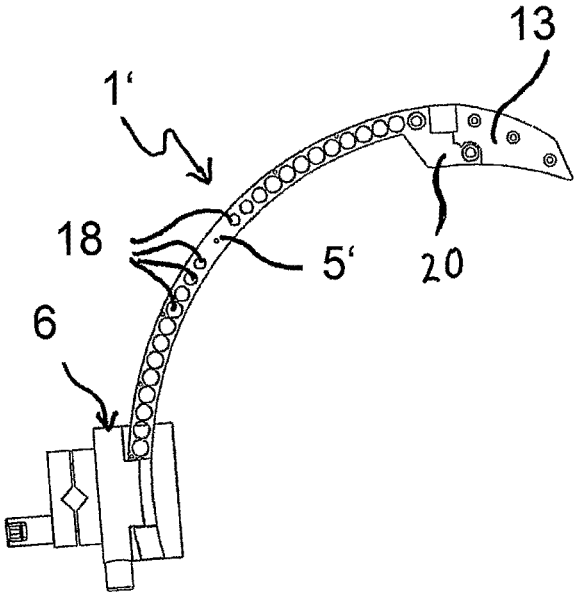

There are shown in:

FIG. 1 a perspective representation of the device for a percussion instrument with a holder for an apparatus for altering the pitch of the percussion instrument;

FIG. 2 a partial view from behind of the device fora percussion instrument with a clip;

FIG. 3 a schematic partial view from the front of the device for a percussion instrument with a clip, viewed from the front and inclined from above;

FIG. 4 another variant of an apparatus according to the invention for adjusting the attack and decay behaviour, in particular the note length of a percussion instrument, with recesses provided in the prongs of a clip and variable connecting parts.

FIGS. 1 to 3 show a device 1 for a drum 2 with a fastening end 20, which is screwed to a fastening plate or fastening block (not shown) arranged on the inside of the shell 8. The apparatus 3 for altering the note length of the percussion instrument 2 consists substantially of a clip 5 divided in the longitudinal direction, open at one end, which thus consists of two substantially identical, parallel prongs 4*a*, 4*b*. The drum 2 equipped with the device 1 is as a whole and more generally also called percussion instrument 100. A replaceable, solid connecting part is fastened to the clip end in a self-supporting manner (i.e. not in contact with the shell) as an extension of the fastened end of the clip 5. This connecting part also influences the attack and decay behaviour (note length, timbre etc.) and can be replaced by different connecting parts of a different mass or also made of a different material or with a different construction, in order thus to also be able to influence the attack and decay behaviour of the device according to the invention.

The end of the clip 5 is releasably connected in particular via screws 17 to the shell 8 of the drum 2 or a tom. Arranged on the clip 5, denoted 5 as a whole, is an adjustable fastening device or connecting element 6, to which a support arm or floor support 7 is connected, which can support itself on the floor.

The apparatus 3 of the percussion instrument 100 is formed as a shaped clip 5 and forms an arc which is matched to the outer circumference of a wall 8 of the percussion instrument 2 and runs preferably parallel along the circumference of the shell 8 at a distance from the outside or the wall of the percussion instrument 2. The clip runs approximately horizontal, more precisely parallel, to the plane of the drum head 16 relative to the base of the percussion #n instrument.

The connecting element 6 for the floor support 7 is mounted continuously displaceable along the clip 5 and can be clamped at desired points on the clip 5 with the help of a clamping device, for example a quick clamp 19.

The fastening device or the connecting element 6 has a clamping device with two flange parts 9, 10, of which the surfaces facing each other have recesses the cross section of which is preferably matched to the cross section of the prongs 4*a* and 4*b* of the clip 5, with the result that the flanges 9, 10 clamp on the prongs 4*a* and 4*b* of the clip 5 when pressed together by means of a quick clamp lever 19 or the like, and are continuously displaceable on the clip 5 once the quick clamp lever 19 is loosened.

The fastening device or the connecting element 6 furthermore has an opening 12, in which a support arm or the floor support 7 can be housed and the height of which can be fixed infinitely variably with the help of a tensioning screw 11.

One end of the clip 5 is fastened rigidly and/or also adjustably on the wall of the shell 8 of the percussion instrument 100. There can be seen in FIG. 3 two fastening screws 17, to be screwed from the inside of the shell through the clip end into threaded holes of the clip end, which penetrate a fastening plate, not represented here, on the inside of the shell 8.

Depending on the design of the fastening, it could also be possible, as required, to alter the distance between the flange 9 and the outside or the wall 8. In other words, to tilt the clip towards the shell wall or at a greater distance relative thereto.

The connecting part 13 consists of two substantially identical blocks 13 arranged at a distance from each other, which are separated from each other by the spacer 21, which also serves as a connecting plate and simultaneously also as a spacer 21 for the prongs 4*a*, 4*b* of the clip 5. The prongs 4*a*, 4*b* are braced with the spacer 21, the two blocks 13 of the connecting part are matched in their shape to the spacer 21 (or vice versa) and at their end facing away from the clip 5 run tapered in an arc shape or wedge shape.

The connecting part 13, as a solid (and in this case relatively high-mass) extension of the clip 5, can be formed of one or more parts which are connected to each other, as can be seen in the embodiment according to FIG. 4. In this case, the connecting part consists of two blocks made of metal, in particular steel or stainless steel, separated from each other by a spacer 21.

The drum 2 and the clip 5 function, like a tuning fork, as a flexural resonator, where it might be said that the clip 5 forms one half of the tuning fork and the drum 2 forms the other half, wherein however one prong of the tuning fork is fixed by the connecting element, which leads to a shift in the phase position of the structure-borne sound, and positive and negative interference effects can occur.

All known devices for suspending drums merely attempt to decouple the drums from the stand, whereas according to the present invention the vibration capacity of a mounting suspension (in the form of the clip 5) is expressly desired and can be varied in a targeted manner by adjusting the connecting element 6 on the clip 5. In the present case, the invention is based on the notion of giving the shell sufficient freedom of movement so that it can reverberate for a suitable length of time. The connection of the shell to a stand or mounting suspension is limited to the connection to one end of the clip, which for its part is at an adjustable distance from the connecting element 6, with the result that this end of the clip can also resonate. This resonating behaviour and thus the note length (the sustain) is altered by adjusting the distance from the connecting element 6. The further the connecting element to a stand or similar is from the clip end fastened to the shell, the longer the note or reverberation becomes. As a second-order effect, the pitch can also change slightly, but is adjustable in principle, and largely independently of the note length, via the tension of the head. The timbre and in very general terms the attack and decay behaviour can thus also be effectively influenced, wherein the connecting part, consisting of two blocks 13, which are provided as an extension of the fastened clip end, also have a considerable influence on this attack and decay behaviour.

Thus a perfect vibration behaviour is ensured on the drum. The combination of drum and the apparatus 3 for altering the note length and/or pitch has the effect for example that a thick-walled drum shell can also sound like a thin-walled shell.

FIGS. 2 and 3 show, in each case from different directions, a perspective view of the device 3 for adjusting the note length of a percussion instrument 100.

The device 1 consists substantially of a clip 5 and a connecting element 6, which is displaceable on the clip 5 and can produce a connection of the clip 5 to a stand or a tripod post 7 (not represented in FIGS. 2 and 3), and, by means of the flanges 9, 10 and the quick clamp 19, simultaneously also forms a connecting element 6, which can be clamped at a desired position on the clip 5. The clip 5 and the connecting element 6 together form the apparatus 3 for adjusting the note length, which can be additionally modified by the connecting part 13. The clip 5 can consist of one or two prongs 4*a*, 4*b*, arranged at a distance from each other, on which a connecting element 6 is housed displaceable.

The percussion instrument 100 described in the description and in the claims can be a drum 2 or tom or a cymbal or an instrument which is covered with one or more heads 16 consisting of animal skins 16, plastic or another thin material.

FIGS. 4*a-c* show two perspective views of a device 1' with an apparatus 3 for altering the note length (FIGS. 4*a, b*) as well as a top view from above onto such an apparatus (FIG. 4*c*), each with a connecting part 13 and a connecting element 6.

This embodiment, which completely or at least largely corresponds to the embodiment represented in the previous figures in respect of its external shape and its dimensions, differs from the previously described embodiments among other things in that the two prongs 4*a*, 4*b* of the clip 5' each have a plurality of holes 18 which extend perpendicular to the plane of curvature of the clip 5'. As can be seen, the holes 18 in this case have sometimes different diameters and have, in particular approximately in the middle of the clip 5', a smaller diameter and are at a greater distance from each other. The holes change the moment of inertia of the clip 5' and thus also its natural frequency together with the connecting element 6, which is displaceable and clampable along the clip 51.

A further difference from the embodiment of FIGS. 1 to 3 is the formation of the connecting part 13 in the form of a stack of identically shaped disks, which can however be separated by interlayers of a different material and can be assembled differently in each case, above all with a different total mass.

LIST OF REFERENCE NUMBERS

1 device
2 percussion instrument, drum, tom, cymbal
3 apparatus for altering the note length
4*a* prong of the clip 5
4*b* prong of the clip 5
5 clip
6 connecting element
7 support arm, floor support
8 wall
9 flange part
10 flange part
11 clamping screw
12 opening
13 connecting part
16 drum head
17 screw
18 shell of the drum

19 quick clamp lever
20 fastening end
21 spacer

The invention claimed is:

1. A device for a percussion instrument comprising:

an apparatus for altering the one or more of note length, notes, and timbre of the percussion instrument, the apparatus configured to be fastened to the percussion instrument and including a clip on which an adjustable connecting element is arranged, the clip configured to connect to one of a support arm and a floor support, wherein exclusively one end of the clip is configured to be fastened to a shell of the percussion instrument, and wherein one of a fastening device and a connecting element for the floor support is mounted displaceable on the clip and fixable to a desired point on the clip via a clamping device.

2. The device according to claim 1, further characterized in that the clip is formed as a shaped clip.

3. The device according to claim 1, further characterized in that the one fastened end of the clip is connected one of rigidly and adjustably to a replaceable, self-supporting connecting part, which is an extension of the clip beyond its one fastened end.

4. The device according to claim 3, further characterized in that the connecting part is formed in several parts.

5. The device according to claim 4, further characterized in that the connecting part includes a stack of identically shaped disks, at least some of which are of the same material.

6. The device according to claim 1, further characterized in that the clip forms an arc configured to be matched to an outer circumference of a wall of the percussion instrument and arranged at a distance from an outside of the wall of the percussion instrument.

7. The device according to claim 1, further characterized in that one of the fastening device and the connecting element is a part of the clamping device, the clamping device having flange parts, wherein a first one of the flange parts is configured to be pressed on an inside of the clip and a second one of the flange parts is configured to be pressed on an outside of the clip via one of a quick clamp and at least one tensioning screw.

8. The device according to claim 1, further characterized in that one of the fastening device and the connecting element has an opening configured to house and fix one of the support arm and the floor support.

9. The device according to claim 1, further characterized in that the clip is configured to be connected one of rigidly and adjustably to the percussion instrument.

10. The device according to claim 1, further characterized in that the clip has inner cavities in the form of holes.

11. The device according to claim 10, further characterized in that the inner cavities are several holes in the clip that extend perpendicular to a plane of curvature of the clip.

12. The device according to claim 1, further comprising: the percussion instrument.

13. The device according to claim 12, further characterized in that the percussion instrument includes a drum head and a drum hoop.

14. The device according to claim 12, further characterized in that the percussion instrument is one of a drum, a tom, a cymbal, and an instrument covered with one or more heads made from one of animal skins, plastic, and another thin material.

15. A device for a percussion instrument comprising:

an apparatus for altering the one or more of note length, notes, and timbre of the percussion instrument, the apparatus configured to be fastened to the percussion instrument and including a clip on which an adjustable connecting element is arranged, the clip configured to connect to one of a support arm and a floor support, the apparatus further including a connecting part formed in several parts and curved in an arc shape and tapered in a wedge shape, the connecting part configured to be without direct contact with a shell wall of the percussion instrument.

16. A device for a percussion instrument comprising:

an apparatus for altering the one or more of note length, notes, and timbre of the percussion instrument, the apparatus configured to be fastened to the percussion instrument and including a clip on which an adjustable connecting element is arranged, the clip configured to connect to one of a support arm and a floor support, the clip including two prongs arranged at a distance from each other, the connecting element displaceably positioned on the two prongs.

17. A device for a percussion instrument comprising:

an apparatus for altering the one or more of note length, notes, and timbre of the percussion instrument, the apparatus configured to be fastened to the percussion instrument and including a clip on which an adjustable connecting element is arranged, the clip configured to connect to one of a support arm and a floor support, the clip arranged self-supporting over a portion of its length starting from one end configured to be fastened to the percussion instrument, wherein the clip is configured to be one of:

positioned in a plane parallel to a drum head plane of the percussion instrument, and changeable in angular position with reference to the drum head plane of the percussion instrument.

* * * * *